US008469229B2

(12) United States Patent
Personeni

(10) Patent No.: US 8,469,229 B2
(45) Date of Patent: Jun. 25, 2013

(54) PRODUCT VENDING MACHINE

(75) Inventor: Silvano Personeni, Mazzoleni (IT)

(73) Assignee: N&W Global Vending S.p.A., Valbrembo (IT)

( * ) Notice: Subject to any disclaimer, the term of this patent is extended or adjusted under 35 U.S.C. 154(b) by 3 days.

(21) Appl. No.: 13/260,951

(22) PCT Filed: Mar. 29, 2010

(86) PCT No.: PCT/EP2010/054071

§ 371 (c)(1), (2), (4) Date: Dec. 19, 2011

(87) PCT Pub. No.: WO2010/112448

PCT Pub. Date: Oct. 7, 2010

(65) Prior Publication Data

US 2012/0125946 A1 May 24, 2012

(30) Foreign Application Priority Data

Mar. 30, 2009 (IT) ..... TO2009A0241

(51) Int. Cl.

| | |
|---|---|
| ***G07F 11/10*** | (2006.01) |
| ***E05B 65/44*** | (2006.01) |
| ***A47F 1/04*** | (2006.01) |

(52) U.S. Cl.

USPC ..... 221/154; 221/133; 221/283; 221/185; 221/151

(58) Field of Classification Search

USPC ..... 221/154, 282–283, 151–152, 133, 221/64, 185

See application file for complete search history.

(56) References Cited

U.S. PATENT DOCUMENTS

| | | | | |
|---|---|---|---|---|
| 4,757,915 | A * | 7/1988 | Albright et al. | 221/75 |
| 5,205,436 | A | 4/1993 | Savage | |
| 5,392,951 | A * | 2/1995 | Gardner et al. | 312/319.5 |
| 6,302,293 | B1 * | 10/2001 | Wittern et al. | 221/92 |
| 6,616,010 | B2 * | 9/2003 | Yuyama et al. | 221/197 |
| 7,886,932 | B2 * | 2/2011 | Yanagisawa et al. | 221/197 |
| 2001/0000609 | A1 * | 5/2001 | Rudick et al. | 221/6 |
| 2007/0221680 | A1 * | 9/2007 | Yuyama | 221/124 |

FOREIGN PATENT DOCUMENTS

| | | |
|---|---|---|
| CA | 2451946 | 6/2005 |
| DE | 9420359 | 2/1995 |
| DE | 20315217 | 12/2003 |
| DE | 202006013213 | 11/2006 |
| DE | 102005054006 | 5/2007 |
| EP | 1975892 | 10/2008 |
| GB | 2447033 | 9/2008 |
| NL | 1010947 | 7/2000 |

OTHER PUBLICATIONS

International Search Report and Written Opinion from International Application No. PCT/EP2010/054071, dated May 7, 2010.

International Preliminary Report on Patentability from International Application No. PCT/EP2010/054071, dated Jul. 8, 2011.

* cited by examiner

*Primary Examiner* — Michael K Collins

(74) *Attorney, Agent, or Firm* — Workman Nydegger

(57) ABSTRACT

A product vending machine having a locking device, wherein a column of rollers, fitted along a guide with sufficient play to roll along the guide, is selectively engaged by one of a number of wedge members to eliminate the play and move the rollers into a compact configuration preventing insertion of the other wedge members; each wedge member being movable with a relative movable part, e.g. a tray or a door, of the machine.

8 Claims, 4 Drawing Sheets

PRODUCT VENDING MACHINE

CROSS-REFERENCE TO RELATED APPLICATIONS

This application is a U.S. Nationalization of PCT International Application No. PCT/EP2010/054071 filed 29 Mar. 2010, entitled "PRODUCT VENDING MACHINE," which claims priority to Italian Patent Application No. TO2009A000241 filed 30 Mar. 2009, the contents of both of the foregoing applications are incorporated herein, in their entirety, by this reference.

TECHNICAL FIELD

Embodiments of the present invention relate to a product vending machine.

More specifically, embodiments of the present invention relate to a product vending machine of the type comprising a cabinet defining a space; and a number of movable parts comprising a front door for closing the space, and a number of trays arranged inside the space and for supporting respective numbers of products; each movable part being movable between a respective first and a respective second operating position.

BACKGROUND ART

The trays in vending machines of the above type are normally moved from a normal stowed position inside the space, to an extracted loading position, after first opening the door, for easy product loading by an operator.

The relatively heavy weight of the trays when loaded poses the problem of enabling movement of one tray at a time, when loading the products, to prevent the machine from toppling over.

In normal, i.e. closed-door, operating conditions, vending machines of the above type also pose the problem of securing the trays in their respective stowed positions, so that, in the event of violent shaking of the machine, e.g. by vandals, the trays are prevented from working loose and crashing into the door, thus damaging both the door and the trays, and possibly also toppling the machine.

SUMMARY

One or more embodiments of the present invention provide a product vending machine designed to provide a straightforward, low-cost solution to both the above problems.

According to an embodiment of the present invention, there is provided a product vending machine. The product vending machine includes a locking device, and a column of rollers fitted along a guide with sufficient play to roll along the guide. The column is selectively engaged by one of a number of wedge members to eliminate the play and move the rollers into a compact configuration preventing insertion of the other wedge members. Each wedge member is movable with a relative movable part (e.g. a tray or a door) of the machine.

BRIEF DESCRIPTION OF THE DRAWINGS

A non-limiting embodiment of the present invention will be described by way of example with reference to the accompanying drawings, in which.

BEST MODE FOR CARRYING OUT THE INVENTION

Figure 1:
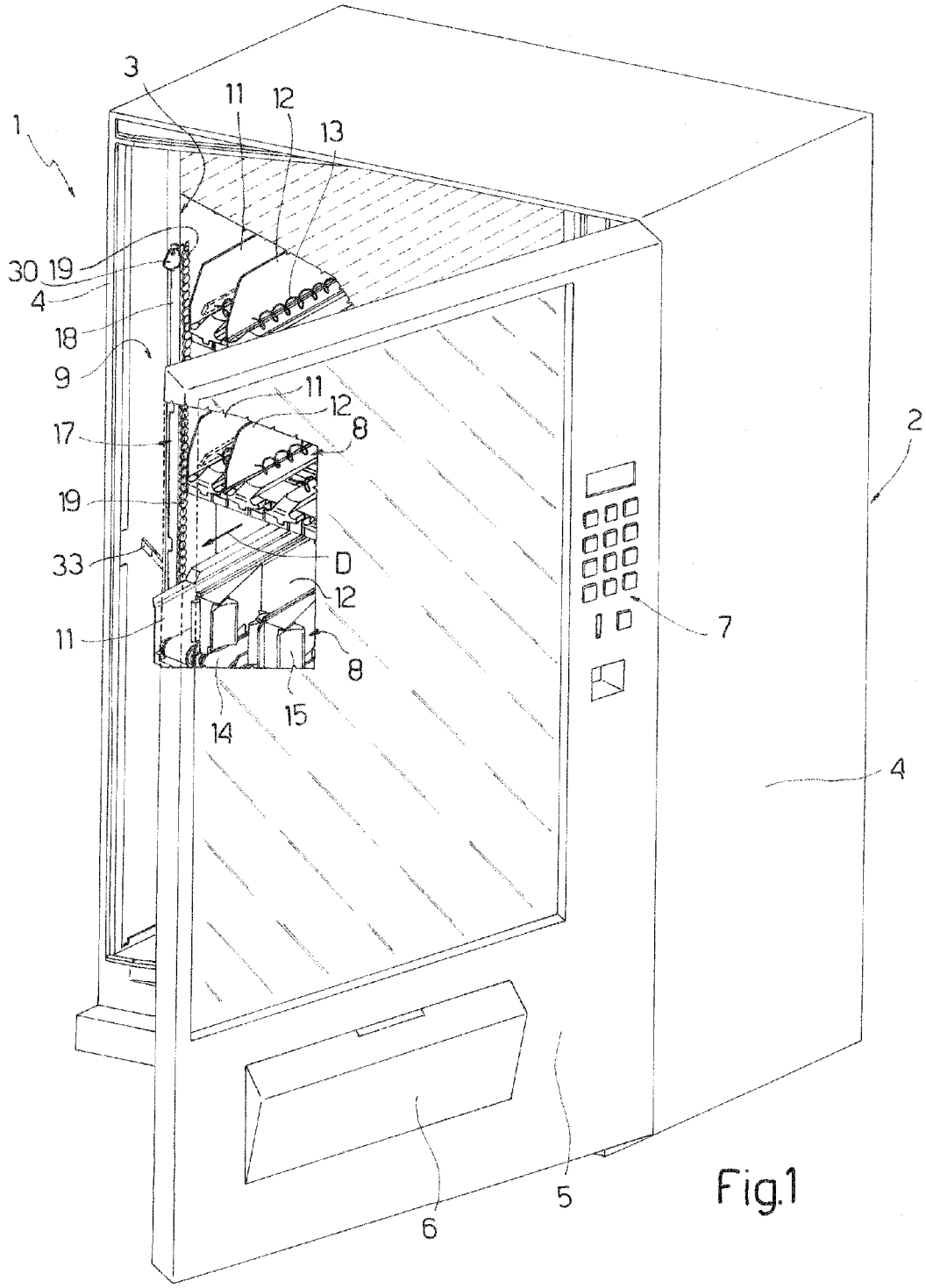
FIG. 1 shows a view in perspective of a preferred embodiment of the vending machine according to the present invention.

Number 1 in FIG. 1 indicates as a whole a product vending machine comprising a cabinet 2, which defines an internal space 3, and has two lateral walls 4, and a front door partly defined by a panel of transparent material. A hatch 6 in a bottom portion of door 5 closes a take-out bin (not shown) connected to the inner side of door 5, and can be opened from the outside to allow the user to remove a product selected on a pushbutton panel 7 on door 5, alongside the panel of transparent material.

Figure 3:
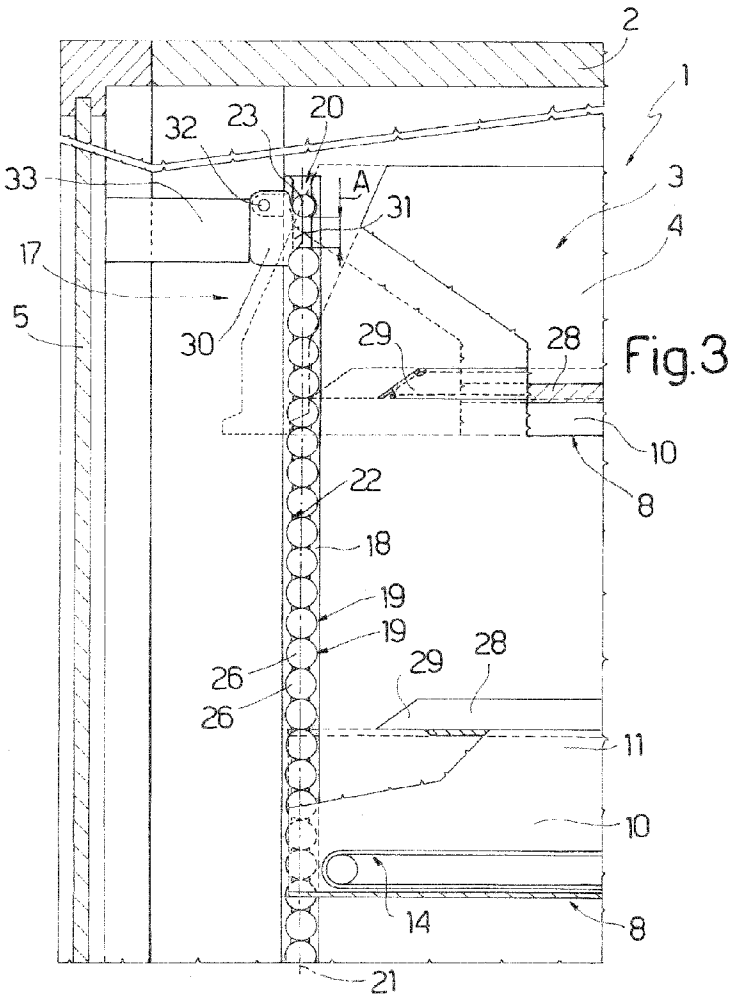

Inside space 3, machine 1 houses a number of product-supporting trays 8, which are positioned facing door 5, are arranged one over the other and spaced apart vertically, and extend between lateral walls 4, in respective substantially horizontal planes crosswise to lateral walls 4 and door 5. As shown in FIG. 1 and more clearly in FIG. 3, in the normal vending position, trays 8 occupy a rear portion of space 3, so as to define, between door 5 and the respective front ends of the trays facing door 5, a drop shaft 9 communicating with the take-out bin (not shown) underneath.

Figure 2:
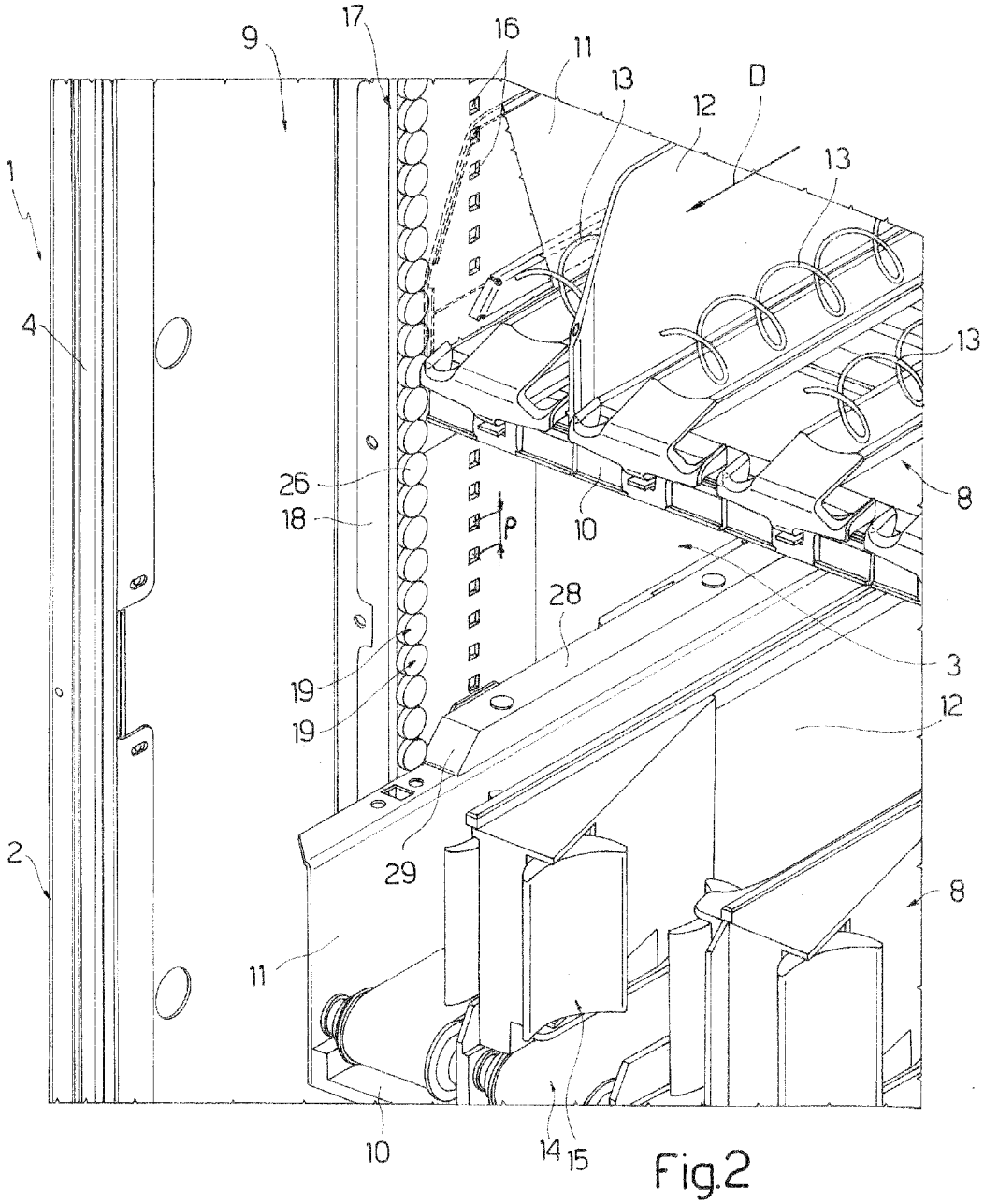
FIG. 2 shows a larger-scale detail of FIG. 1.

With reference to FIGS. 1 and 2, each tray 8 comprises a frame defined by a base 10 lying in a substantially horizontal plane; by two sides 11, each facing a respective lateral wall 4 of cabinet 2; and by a number of partitions 12 perpendicular to base 10 and door 5, and which divide tray 8 into a number of channels, which may be of different widths, extend perpendicular to door 5, and each house a number of products arranged in one or more columns, depending on the width of the channel.

Each channel has powered conveying means, which are activated selectively, in use, to feed a relative column of products along the channel in a travelling direction D perpendicular to door 5, and feed the products one at a time into drop shaft 9.

Each channel of the top tray 8 in FIG. 2, for example, has, for each column of products, a spiral conveyor 13 for feeding the relative products in direction D to drop shaft 9; and each channel of the bottom tray 8 in FIG. 2 has, for each column of products, a belt conveyor 14 for feeding the relative products in direction D to drop shaft 9 via a respective selective product release device 15. Both spiral conveyor 13 and belt conveyor 14 and relative release device 15 are known and commonly used in the product vending machine industry, and therefore not described in detail.

Figure 4:
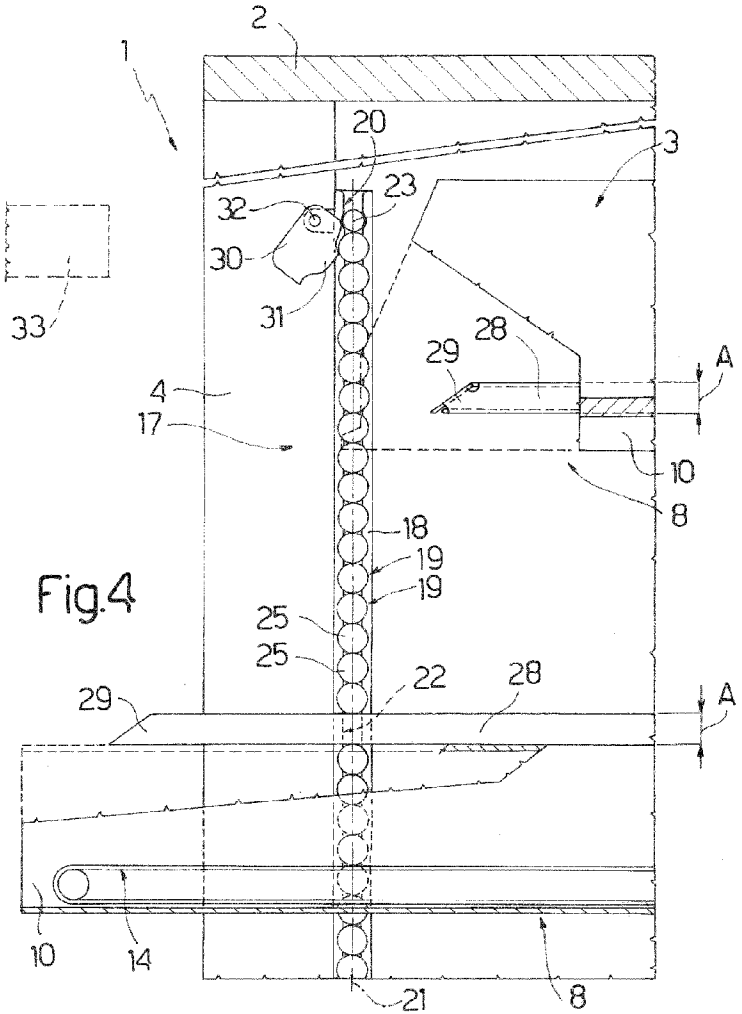
FIGS. 3 and 4 show side views of a FIG. 1 detail in respective operating configurations.

To enable the operator to load the products easily onto trays 8, each tray 8 is mounted between lateral walls 4, so that, when door 5 is opened, the tray can be moved in direction D from the normal vending position (top tray in FIG. 4) to a loading position (bottom tray in FIG. 4), in which tray 8 projects partly from space 3, across drop shaft 9.

To permit this movement, the frame of each tray 8 comprises two lateral guides (not shown), each of which is integral with an edge of the frame facing a corresponding lateral wall 4, is engaged in sliding manner by base 10, and removably engages at least two fastening cavities 16, which are coplanar with each other and with the cavities 16 engaged by the other lateral guide, and lie in a horizontal plane perpendicular to door 5. More specifically, the cavities 16 in each lateral wall 4 are arranged in at least two parallel vertical columns (only one shown in FIG. 2), in each of which, cavities 16 are equally spaced with a given centre distance P, so the height of each tray 8 can be adjusted, in use, by the operator simply moving tray 8 to a different level, as required.

Figure 5:
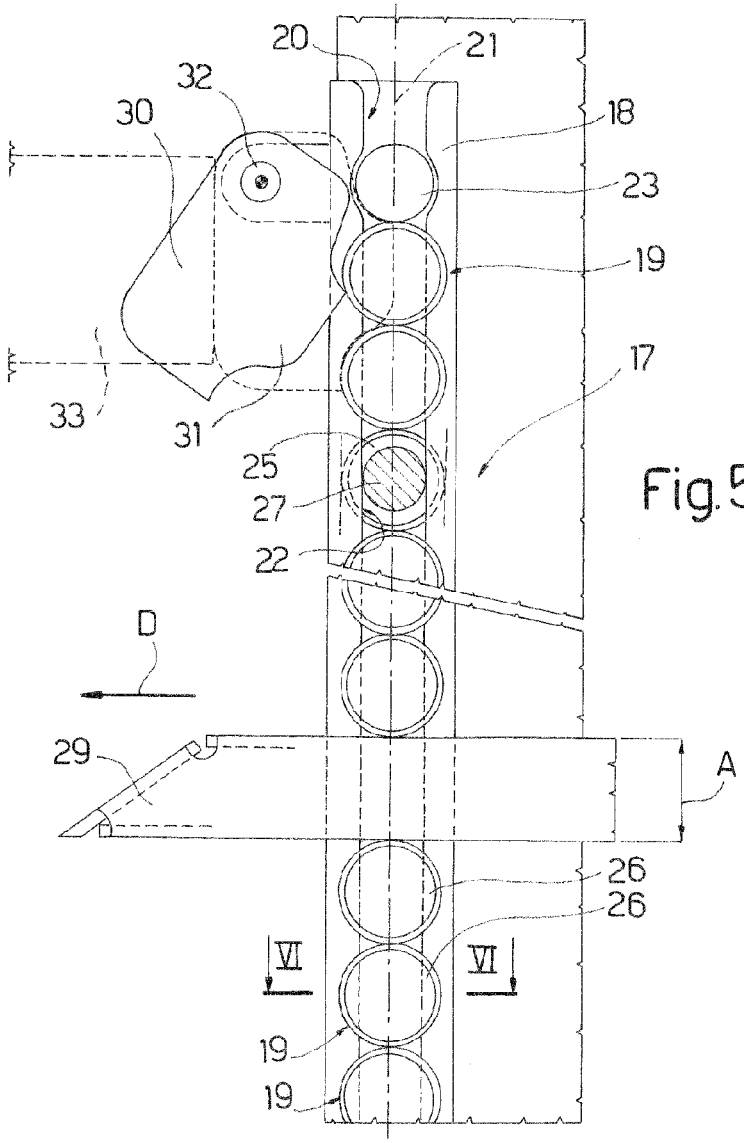
FIG. 5 shows a larger-scale view, with parts removed for clarity, of a detail in FIG. 4.

As shown in FIGS. 1, 2 and 5, machine 1 also comprises a locking device 17, which, when door 5 is closed, locks all the trays 8 in their respective vending positions, and, when door 5 is open and one tray 8 is in the loading position, locks all the other trays 8 in their respective vending positions, i.e. only allows one tray 8 at a time to be extracted.

Locking device 17 comprises a rolling member retainer defined by a tubular guide 18 connected rigidly to a lateral wall 4 and extending vertically between trays 8 and drop shaft 9; and a column of rollers 19 fitted in transversely rolling manner to guide 18.

Figure 6:
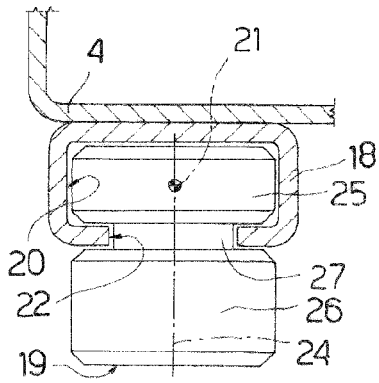
FIG. 6 shows a section along line VI-VI in FIG. 5.

More specifically, as shown in FIG. 5 and in more detail in FIG. 6, guide 18 is defined by a tubular C-section profile defining an internal cavity 20, which is coaxial with a vertical axis 21, is open outwards through a longitudinal slit 22 on the side facing the opposite lateral wall 4 to the one supporting guide 18, and is closed at its axial ends by two stops 23 (only the top one of which is shown in the drawings) defining respective stops of guide 18.

Each roller 19 has an axis 24 perpendicular to axis 21, and comprises two end portions 25, 26 of the same diameter, and of which portion 25 is housed in transversely rolling manner inside cavity 20; and a smaller-diameter centre portion 27, which connects portions 25 and 26, and engages slit 22 in transversely rolling manner to guide roller 19 along guide 18.

When locking device 17 is idle (not shown), the column of rollers 19 is seated loosely in guide 18, with an amount A of play, along axis 21, equal to roughly the diameter of a roller 19. Being free to roll along slit 22, rollers 19 therefore rest by gravity one on top of the other and on top of the bottom stop 23 (not shown), and a gap of size A, equal to the amount of play, is formed between the top stop 23 and the top roller 19 in the column.

Locking device 17 also comprises wedging means designed to selectively fit between rollers 19 to eliminate the play between rollers 19 and so move the column of rollers 19 into a compact operating configuration, in which the column of rollers 19 forms a barrier in front of trays 8, to prevent trays 8 in the vending position from moving into the loading position.

As stated, when door 5 is open, the wedging means are activated, by moving a tray 8 into the loading position, to lock all the other trays 8 in the vending position, or are activated by closing door 5, to lock all of trays 8 in the vending position.

To achieve the first of the above locking modes, the wedging means comprise, for each tray 8, a rod 28, which is connected rigidly to the side of tray 8 facing the lateral wall 4 supporting guide 18, extends in a horizontal direction parallel to said lateral wall 4, and has a sharp end 29, which is positioned with its tip facing guide 18, lies in the tangency plane of two rollers 19, and is aligned with the contact line of the two rollers 19. Consequently, when one of trays 8 is moved, together with respective rod 28, from the vending to the loading position (FIG. 4), rod 28 is inserted between the two rollers 19 aligned horizontally with it, so as to raise the column of rollers 19 above tray 8. Each rod 28 is of a thickness substantially equal to the amount A of play, so that, when rod 28 is inserted between two rollers 19 aligned with it, the top roller 19 in the column is pushed against the top stop 23, and rollers 19 assume the compact configuration preventing insertion of another rod 28.

As shown in FIG. 2, depending on the type of tray 8 and the space available on it, rod 28 may be located on a top edge of the side 11 facing guide 18 (as in the case of tray 8 with belt conveyor 14), or on the outside of side 11, on a lateral edge of base 10 (as in the case of tray 8 with spiral conveyor 13).

Regardless of where rod 28 is located on tray 8, it is important that end 29 be substantially aligned horizontally with the contact line of two rollers 19, so that rod 28 fits smoothly between the two rollers 19 when tray 8 is moved into the loading position.

Accordingly, and since, as stated, trays 8 can be positioned at different heights inside space 3 by means of cavities 16, the centre distance of rollers 19 equals the centre distance of cavities 16. Once the correct position of rod 28 on tray 8 is established, the above alignment is therefore achieved for each height of tray 8 inside space 3.

To lock all of trays 8 when door 5 is closed, the wedging means comprise a wedge member 30 located between door 5 and guide 18, close to the top stop 23, and defined by a substantially rectangular plate. This has a projection 31 on the side facing guide 18, and is hinged to wall 4 to oscillate, about a pin 32 parallel to axes 24, between a rest position (FIGS. 4, 5), assumed when door 5 is open and in which wedge member 30 does not interfere with guide 18 or the column of rollers 19, and a work position (FIG. 3) assumed when door 5 is closed and trays 8 are all in the vending position, and in which wedge member 30 is pushed against guide 18 by a fixed push member 33 integral with door 5, so that projection 31 completely fills the gap between top stop 23 and the top roller 19 in the column, thus eliminating the play between guide 18 and rollers 19, which therefore assume the compact configuration, so that, when door 5 is closed, none of trays 8 can move out of the vending position.

Operation of machine 1 is clear from the above description, with no further explanation required.

To conclude, it should be pointed out that, in a version not shown, as opposed to being located along drop shaft 9, guide 18 may be located in the rear of space 3, alongside trays 8. In which case, transmission members are interposed between each tray 8 and respective rod 28, and between push member 33 and wedge member 30, so that movement of tray 8 moves rod 28, and movement of push member 33 moves wedge member 30, as described above.

The invention claimed is:

1. A product vending machine, comprising:

a cabinet defining a space;

a front door movable between an open and a closed position opening and closing the space, respectively;

a number of trays, each of which is arranged inside the space to support respective numbers of products and is mounted to move, crosswise to the front door, between a product vending position completely inside the space, and a partly extracted product loading position;

a locking device comprising a guide located in a fixed position inside the space and extending in a direction substantially parallel to the door, and a number of locking members fitted to the guide with sufficient play to move along the guide; and key means comprising a number of first wedge members each of which is selectively operated by a respective one of the trays moving into the respective loading position, to move into a locking position, in which the first wedge member is inserted between the locking members to eliminate the play and move the locking members into a compact configuration preventing insertion of the other first wedge members and locking all the other trays in the vending position;

wherein the key means comprise:

a second wedge member that is operated by the door moving into the closed position, to move into a locking position, in which the second wedge member is inserted between the locking members to eliminate the play and move the locking members into the compact configuration preventing insertion of the first wedge members and locking all the trays in the vending position.

2. The machine as claimed in claim 1, wherein the guide is fixed to the cabinet, and the locking members are defined by rollers, which have respective axes substantially parallel to one another and to the door, and are mounted to roll transversely along the guide.

3. The machine as claimed in claim 2, wherein the cabinet comprises two lateral walls; and the guide is connected rigidly to one of the lateral walls.

4. The machine as claimed in claim 3, wherein the trays extend between the lateral walls, in respective substantially horizontal planes extending crosswise to the lateral walls and the door; the lateral walls having adjusting means configured to position the trays at different levels inside the space, according to a given center distance (P) of the adjusting means, which is substantially equal to the center distance of each two adjacent rollers.

5. The machine as claimed in claim 1, wherein each tray is fitted with a respective wedge member connected rigidly to the tray.

6. The machine as claimed in claim 5, wherein each tray comprises a rod located along a lateral edge of the tray-facing the lateral wall fitted with the guide; each rod comprising a sharp end facing and aligned with a contact line between two adjacent rollers, and defining a relative wedge member.

7. The machine as claimed in claim 1, wherein the second wedge member operated by the door is fitted to one of the lateral walls.

8. A product vending machine, comprising:

a cabinet defining a space;

a front door movable between an open and a closed position opening and closing the space, respectively;

a number of trays, each of the trays arranged inside the space to support respective numbers of products and mounted to move, crosswise to the front door, between a product vending position completely inside the space, and a partly extracted product loading position;

a locking device comprising a guide located in a fixed position inside the space and extending in a direction substantially parallel to the door, and a number of locking members fitted to the guide with sufficient play to move along the guide; and a number of first wedge members, each of the first wedge member selectively operated by a respective one of the trays moving into the respective loading position, to move into a locking position, in which the first wedge member is inserted between the locking members to eliminate the play and move the locking members into a compact configuration preventing insertion of the other first wedge members and locking all the other trays in the vending position; and a second wedge member that is operated by the door moving into the closed position, to move into a locking position, in which the second wedge member is inserted between the locking members to eliminate the play and move the locking members into the compact configuration preventing insertion of the first wedge members and locking all the trays in the vending position.

* * * * *